US012759784B2

(12) United States Patent
Sprouse, II

(10) Patent No.: US 12,759,784 B2
(45) Date of Patent: Oct. 13, 2026

(54) SPRAY DISPENSERS FOR CHEMICAL IRRITANTS AND METHODS OF USE

(71) Applicant: Security Equipment Corporation, Fenton, MO (US)

(72) Inventor: Anthony E. Sprouse, II, Caseyville, IL (US)

(73) Assignee: Security Equipment Corporation, Fenton, MO (US)

( * ) Notice: Subject to any disclaimer, the term of this patent is extended or adjusted under 35 U.S.C. 154(b) by 105 days.

(21) Appl. No.: 18/890,142

(22) Filed: Sep. 19, 2024

(65) Prior Publication Data

US 2025/0100782 A1 Mar. 27, 2025

Related U.S. Application Data

(60) Provisional application No. 63/584,699, filed on Sep. 22, 2023.

(51) Int. Cl.

| | |
|---|---|
| ***B65D 83/38*** | (2025.01) |
| ***B65D 83/384*** | (2025.01) |
| ***B65D 83/40*** | (2006.01) |
| ***F41H 9/10*** | (2006.01) |

(52) U.S. Cl.
CPC ..... *B65D 83/38* (2013.01); *B65D 83/384* (2013.01); *B65D 83/40* (2013.01); *F41H 9/10* (2013.01)

(58) Field of Classification Search
CPC ..... B65D 83/38; B65D 83/384; B65D 83/40; F41H 9/10
See application file for complete search history.

(56) References Cited

U.S. PATENT DOCUMENTS 5,949,338 A * 9/1999 Masi ..... F41H 9/10 116/DIG. 44
11,287,225 B2 * 3/2022 Bogacz ..... F41H 9/10

FOREIGN PATENT DOCUMENTS

DE 20007784 U1 * 9/2001 ..... B65D 83/40

* cited by examiner

*Primary Examiner* — Jennifer C Chiang
(74) *Attorney, Agent, or Firm* — Hartman Global IP Law; Gary M. Hartman; Domenica N.S. Hartman

(57) ABSTRACT

Spray dispensers for spraying a stream of chemical irritant, and methods of use. Such a spray dispenser resembles a lipstick case and is configured to spray a chemical irritant. The dispenser includes a lid that is pivotally attached to a body adapted to contain a canister that contains the chemical irritant, and also preferably includes an anti-rotation actuator for dispensing the chemical irritant.

17 Claims, 4 Drawing Sheets

SPRAY DISPENSERS FOR CHEMICAL IRRITANTS AND METHODS OF USE

CROSS-REFERENCE TO RELATED APPLICATIONS

This application claims the benefit of provisional U.S. Patent Application No. 63/584,699 filed Sep. 22, 2023, the contents of which are incorporated herein by reference.

BACKGROUND OF THE INVENTION

The invention generally relates to spray dispensers for spraying a stream of a chemical irritant, such as pepper spray or mace, and to methods of using such dispensers.

Dispensers adapted to dispense repellents, such as a pepper gel, mace, pepper spray, or other chemical irritant (hereinafter sometimes referred to as pepper spray as a matter of convenience) are prevalent personal safety devices. To disguise pepper spray dispensers, it is known to configure a dispenser to resemble a lipstick applicator (sometimes referred to herein as a lipstick pepper spray dispenser). Existing lipstick pepper spray dispensers include designs having a two-piece aluminum case comprising a body and a separate lid that is completely separable from the body. Separable two-piece designs may be undesirable for some situations and can be undesirably bulky in size. In addition, two-piece designs typically are not configured to be quickly oriented for a particular or pre-defined spray direction. As a result, when the user opens the lid to use the dispenser, the user may accidentally spray him/herself rather than the intended target, such as a perceived attacker.

In view of the above, it would be desirable if a dispenser having an appearance of a lipstick applicator were available that was capable of at least partly overcoming or avoiding shortcomings or disadvantages noted above for existing lipstick pepper spray dispensers.

BRIEF SUMMARY OF THE INVENTION

The intent of this section of the specification is to briefly indicate the nature and substance of the invention, as opposed to an exhaustive statement of all subject matter and aspects of the invention. Therefore, while this section identifies subject matter recited in the claims, additional subject matter and aspects relating to the invention are set forth in other sections of the specification, particularly the detailed description, as well as any drawings.

The present invention provides, but is not limited to, dispensers for spraying a stream of a chemical irritant. A preferred but non-limiting aspect of the invention is that the dispensers resemble a lipstick applicator (case).

According to a nonlimiting aspect of the invention, a spray dispenser for spraying a stream of a chemical irritant includes an elongate body having a longitudinal axis extending from a bottom end to a top end of the body. The body defines an interior cavity configured to receive a canister containing the chemical irritant. A lid is coupled to the top end of the body so as to pivot between a closed position that covers the top end of the body and an open position that exposes the top end of the body. An actuator is disposed at the top end of the body and, when the lid is pivoted to the open position, the actuator is configured to selectively dispense a stream of the chemical irritant from the canister disposed in the interior cavity. The actuator extends into a lid cavity defined inside the lid when the lid is pivoted to the closed position.

According to another nonlimiting aspect of the invention, a method of using a spray dispenser as described above includes pivoting the lid from the closed position to the open position to expose the actuator, pointing the actuator so as to spray a stream of the chemical irritant toward an intended target, and engaging the actuator to spray the stream toward the intended target.

Technical aspects of a spray dispenser as described above preferably include the ability to prevent the loss of the lid by pivotally attaching the lid to the body and/or the ability to prevent or at least reduce the risk of a user accidentally spraying themselves.

These and other aspects, arrangements, features, and/or technical effects will become apparent upon detailed inspection of the figures and the following description.

DETAILED DESCRIPTION OF THE INVENTION

Figure 1:
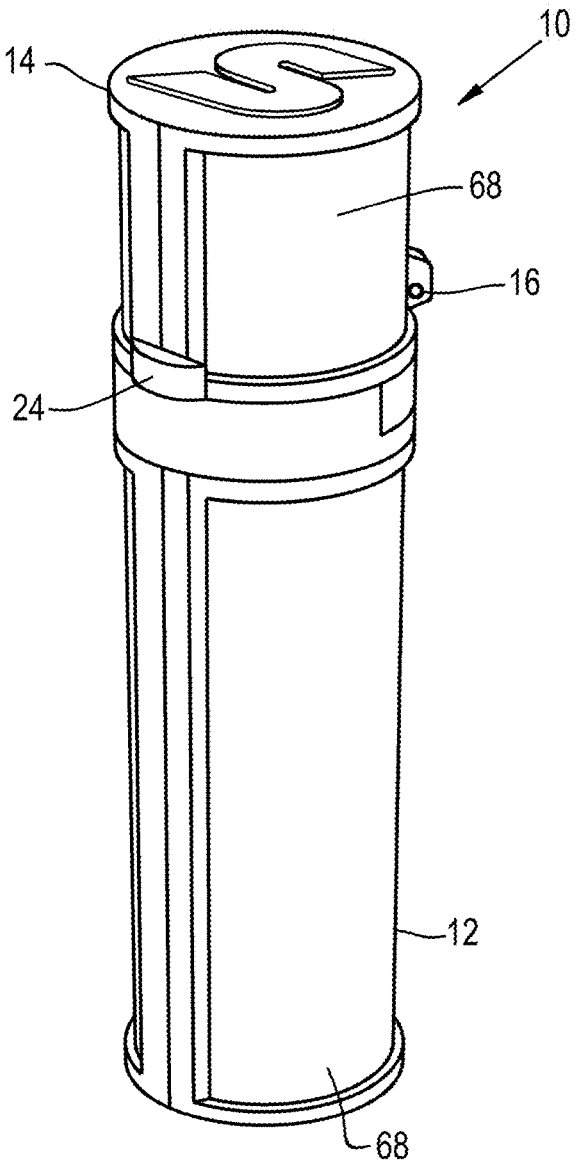
FIG. 1 is a front perspective view of a dispenser exemplifying some but not necessarily all aspects of the present invention.
Figure 2:
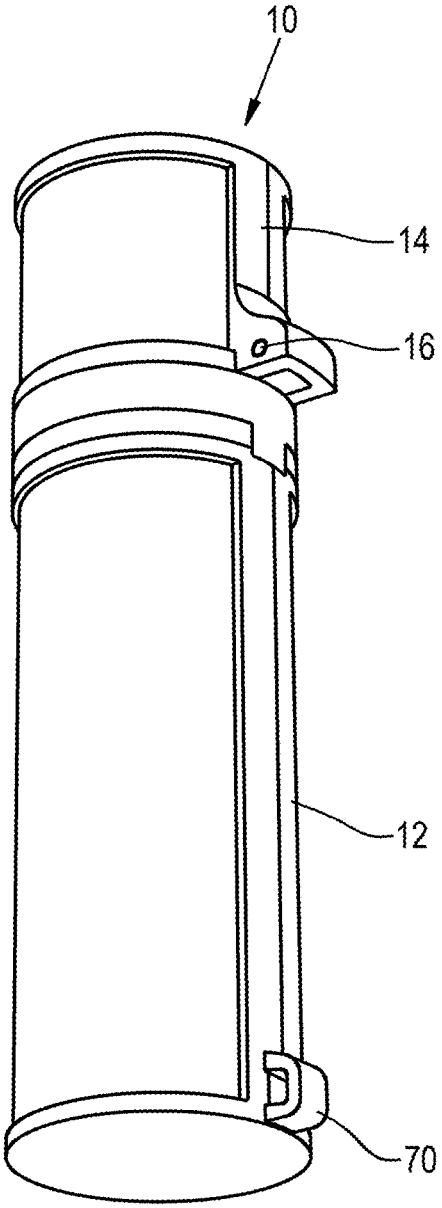
FIG. 2 is a rear perspective view of the dispenser of FIG. 1.
Figure 3:
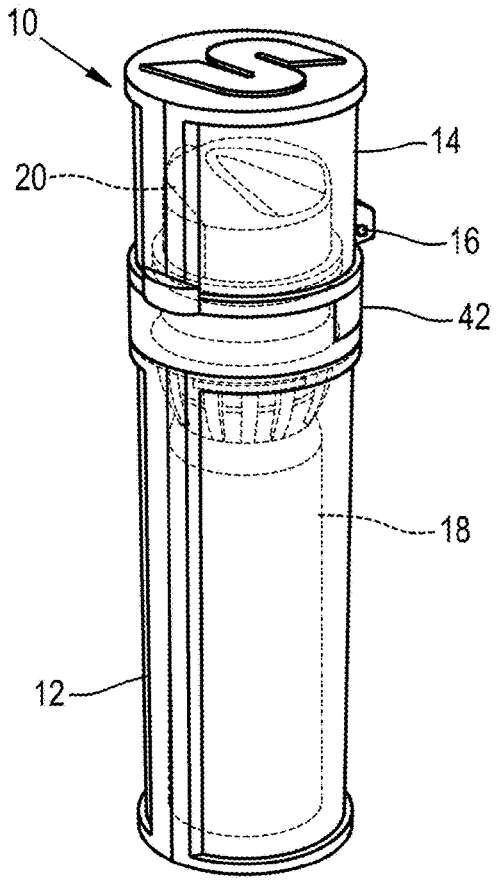
FIG. 3 is another front perspective view of the dispenser of FIG. 1 with some surfaces illustrated as transparent for ease of viewing interior features.

The intended purpose of the following detailed description of the invention and the phraseology and terminology employed therein is to describe what is shown in the drawings, which include the depiction of and/or relate to one or more nonlimiting embodiments of the invention, and to describe certain but not all aspects of the embodiment(s) depicted in the drawings. The following detailed description also identifies certain but not all alternatives of the embodiment(s) depicted in the drawings. As nonlimiting examples, the invention encompasses additional or alternative embodiments in which one or more features or aspects shown and/or described as part of a particular embodiment could be eliminated, and also encompasses additional or alternative embodiments that combine two or more features or aspects shown and/or described as part of different embodiments. Therefore, the appended claims, and not the detailed description, are intended to particularly point out subject matter regarded to be aspects of the invention, including certain but not necessarily all of the aspects and alternatives described in the detailed description.

Although the invention will be described hereinafter in reference to a lipstick pepper spray dispenser 10 shown in the drawings, it will be appreciated that the teachings of the invention are also generally applicable to other types of spray dispensers for spraying a stream of a chemical irritant, such as, but not limited to, spray dispensers that do not necessarily look like lipstick cases, spray dispensers that spray various types of chemical irritants, such as mace or other chemical irritants that can be dispensed in a fluidic manner in the form of a stream of liquid and/or particles.

To facilitate the description provided below of the embodiment(s) represented in the drawings, relative terms, including but not limited to, "proximal," "distal," "anterior," "posterior," "vertical," "horizontal," "lateral," "front," "rear," "side," "forward," "rearward," "top," "bottom," "upper," "lower," "above," "below," "right," "left," etc., may be used in reference to the orientation of the spray dispenser 10 during its use and/or as represented in the drawings. All such relative terms are useful to describe the illustrated embodiment(s) but should not be otherwise interpreted as limiting the scope of the invention.

Figure 4:
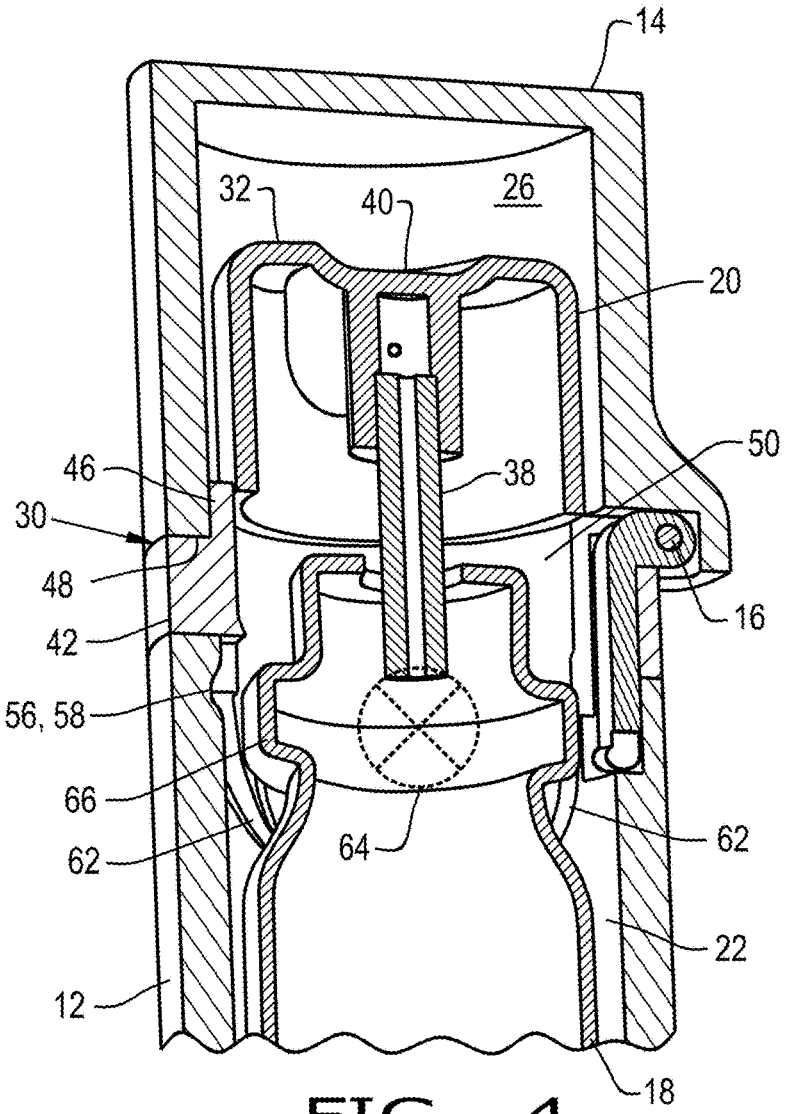
FIG. 4 is a partial cross-sectional view of a top (lid) end of the dispenser of FIG. 1 along a longitudinal axis of the dispenser.
Figure 5:
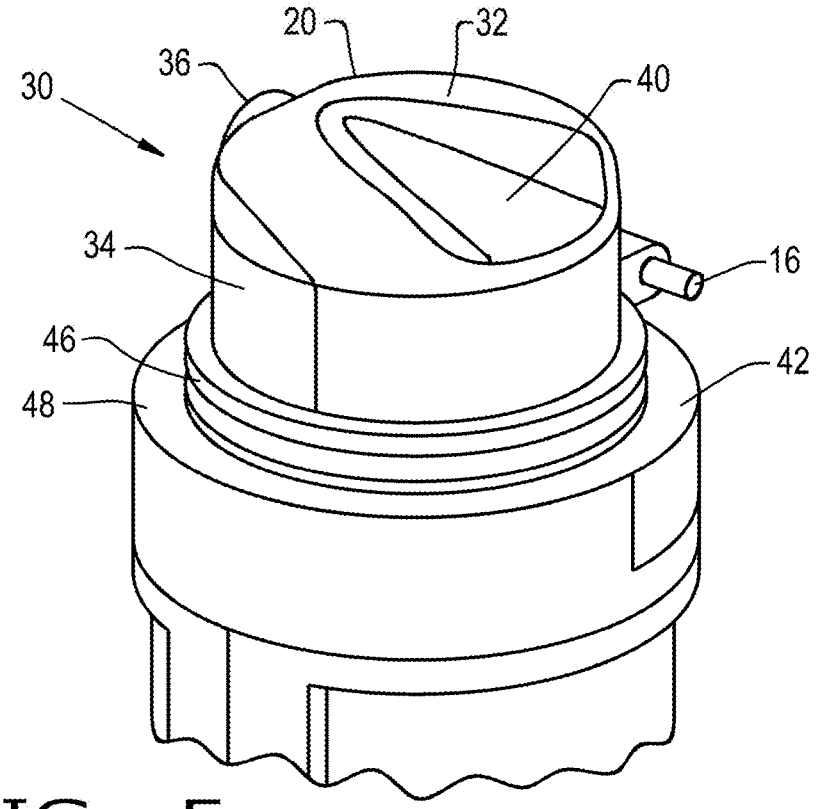
FIG. 5 is an enlarged perspective view of an actuator of the dispenser with the lid removed for clarity.

FIGS. 1 through 6 schematically represent the spray dispenser 10 as having a generally elongate configuration. FIGS. 1 through 4 depict the dispenser 10 in a closed position, in which case the dispenser 10 resembles a lipstick applicator. The spray dispenser 10 includes an elongate body 12 configured to hold a canister 18, a lid 14 pivotably coupled to a top end of the body 12 by a hinge 16, and an actuator 20. The elongate body 12 extends along a longitudinal axis of the dispenser 12, from a bottom end to a top end of the body 12, and defines an interior cavity 22 that is sized and configured to receive the canister 18. As represented in FIG. 4, the actuator 20 is configured to be fluidically coupled with the canister 18 and operable to selectively dispense the chemical irritant from the canister 18 disposed in the interior cavity 22 by spraying a stream of the chemical irritant in a selected direction. Preferably, each of the body 12 and the lid 14 has a generally tubular shape, for example a cylindrical tubular shape or multi-sided tubular shape; though the body 12 and/or the lid 14 may have other decorative shapes, preferably that look like a lipstick case. The canister 18 may be provided as an integral component of the spray dispenser 10, or the canister 18 may be provided separately from the spray dispenser 10 and subsequently installed into the operative position best seen in FIGS. 3 and 4.

The lid 14 pivots about the hinge 16 between the closed position that preferably covers the actuator 20 as shown in FIGS. 1-4, and an open position (not shown) that exposes the actuator 20. In the closed position, the actuator 20 extends upwardly into an interior cavity 26 of the lid 14. In this way, the lid 14 can be easily opened or closed to respectively expose or cover and enclose the actuator 20 by pivoting about the hinge 16. This arrangement also prevents the lid 14 from being accidentally misplaced and/or separated from the body 12. Thus, this hinged lid 14 is capable of preventing or at least reducing the risk that a user might lose the lid 14, which is important for safety in that the lid 14, when fully closed, prevents accidental discharge of the chemical irritant by preventing accidental engagement of the actuator 20. A releasable lock mechanism 24, such as a latch or clasp, may be provided on the lid 14 and/or the body 12 to selectively lock or release the lid 14 from the closed position. A biasing member, such as a coil spring (not shown) optionally may be provided to resiliently urge the lid 14 to automatically rotate about the hinge 16 into the open position when the lock mechanism 24 is selectively released. Such a biasing member may be disposed near the interface between the lid 14 and the body 12, for example at or near the hinge 16.

Each of the body 12 and lid 14 is preferably cylindrical in shape as illustrated in the drawings; however, other tubular shapes could be used. In the nonlimiting embodiment shown in the drawings, each of the body 12 and the lid 14 has substantially the same outer diameter so that, together, the lid 14 and body 12 define a single tubular shape that resembles a lipstick applicator (case or container) when the lid 14 is in the closed position. With the lid 14 pivoted about the hinge 16 into the closed position, the spray dispenser 10 may have various lengths consistent with conventional lipstick applicators, as a nonlimiting example, a longitudinal length of about 5 cm to about 15 cm, preferably about 7.5 cm to about 10 cm, and more preferably less than 8.5 cm. As an additional nonlimiting example, the body 12 and lid 14 may each have a diameter of about 1 cm to about 7.5 cm, more preferably about 2 cm to about 5 cm, and more preferably less than 2.25 centimeters. However, the invention is not necessarily limited to these dimensions and other larger or smaller dimensions may be used if desired.

Figure 6:
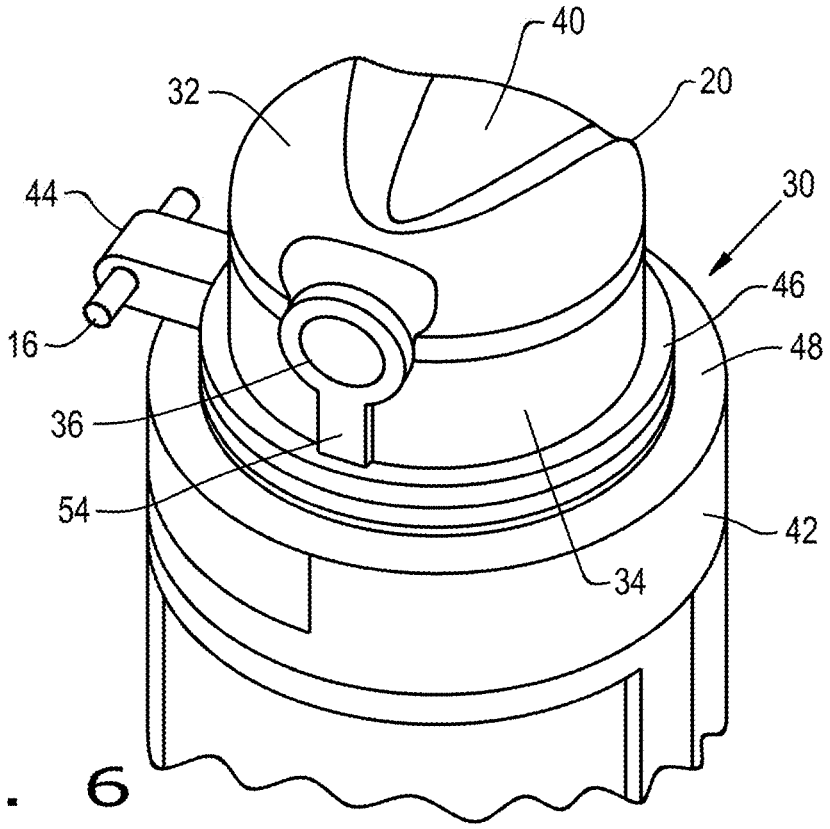
FIG. 6 is another enlarged perspective view of the actuator from a different perspective.
Figure 7:
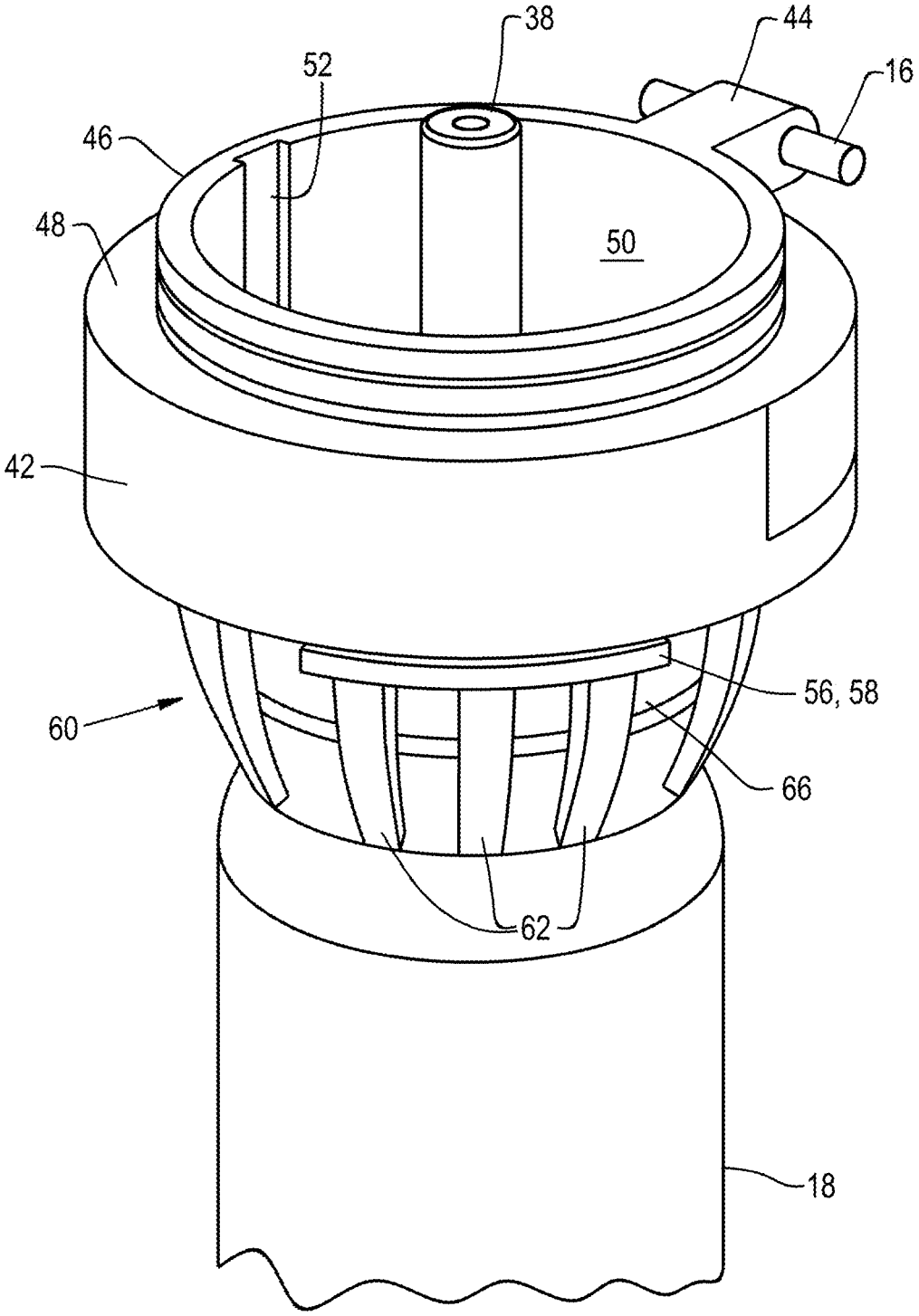
FIG. 7 is an enlarged perspective view of a retention collar of the dispenser releasably attached to the top end of a canister containing a chemical irritant.

Preferably, the spray dispenser 10 includes an anti-rotation actuator assembly 30 configured to prevent rotation of the actuator 20 about the longitudinal axis of the body 12 and thereby maintain the actuator 20 in a preselected rotational orientation relative to the hinge 16. In this way, the actuator 20 can be rotationally oriented on the longitudinal axis in such a manner that is designed to prevent a user from accidentally spraying themselves. This can be particularly important in stressful situations, such as when a user perceives a threat or potential imminent attack from an attacker, when the user may not have time to think quickly enough to ensure otherwise that the actuator is not pointed back at themselves. In the nonlimiting embodiment represented in the drawings, the actuator 20 is represented as generally in the shape of a cylindrical button formed by a generally circular-shaped top wall 32 and a cylindrical-shaped sidewall 34 extending downwardly from the outer periphery of the top wall 32. A spray nozzle 36 is aligned on one side of the actuator 20 to spray a stream radially outwardly from the sidewall 34. The spray nozzle 36 is fluidly coupled to a dispensing tube 38 extending from a top end of the canister 18 so as to receive and direct the chemical irritant from the canister 18 and deliver the irritant to the nozzle 36, from which the irritant is dispensed in a radially outward direction that is substantially parallel to the axis of the hinge 16, as represented in FIG. 6. As used herein, the term "substantially parallel" is meant to encompass angles other than zero degrees to the axis of the hinge 16, for example, angles within a range of about 30° to either side of a line parallel to the axis of the hinge 16, though preferably less than 15° and more preferably less than about 5°. The anti-rotation actuator assembly 30 is configured to allow the actuator 20 to be installed only in this predefined rotational configuration and prevents the actuator 20 from rotating about the longitudinal axis of the body 12 relative to the hinge 16.

To further help a user intuitively engage the actuator 20 and point the spray nozzle 36 at an intended target, a recess 40 is disposed in the top wall 32 of the actuator 20 to receive and intuitively guide the user's finger into a preferred actuation position on the actuator 20. The recess 40 is an elongate recess extending substantially along the axis of the spray nozzle 36 diametrically across the top wall 32 to a diametrically opposite portion of the peripheral sidewall 34 of the actuator 20, thereby forming the recess 40 to be generally shaped to correspond to the shape of a user's finger. In this example, the recess 40 has a generally triangular shape, for example a portion of an oval or similar elongate triangular-shape, with the apex of the triangular shape pointed toward and spaced radially away from the spray nozzle 36. However, the recess 40 may have other shapes configured to receive and intuitively guide the user's finger so as to generally align the spray nozzle 36 pointed away from the user along the axis of the finger engaging the recess 40.

The anti-rotation actuator assembly 30 is represented in the drawings as further including a retention collar 42 that fits onto the top end of the body 12, preferably such that at least a lower portion of the retention collar 42 is received in the top end of the body 12. The hinge 16 is represented as being mounted to the retention collar 42 and disposed in an extension 44 that projects radially outwardly from the retention collar 42 and aligned so that the hinge 16 is substantially parallel to, and preferably spaced radially outwardly from, a tangent of the outer periphery of the retention collar 42. An annular neck 46 extends upwardly from the retention collar 42 and is spaced radially inwardly from the outer periphery of the retention collar 42 so as to form a stepped annular shoulder 48. A longitudinal bore 50 extends longitudinally through the center of the retention collar 42 surrounded by the annular neck 46 and the stepped annular shoulder 48. The longitudinal bore 50 slidably receives the sidewall 34 of the actuator 20 therein such that the outer peripheral surface of the sidewall 34 slidably engages the inner peripheral surface of the longitudinal bore 50. A longitudinal keyway groove 52 is disposed in the inner peripheral surface of the longitudinal bore 50 and receives a complementary key projection 54 projecting radially outwardly from the sidewall 34 of the actuator 20. The key projection 54 slides longitudinally along the keyway groove 52 to allow the actuator 22 to translate in longitudinal directions of the dispenser 10 (up and down as shown in the drawings) in the longitudinal bore 50 to actuate a valve or pump in the canister 18 that selectively releases the chemical irritant from inside the canister 18 and dispenses a stream, such as a spray stream of the chemical irritant radially outwardly through the spray nozzle 36.

The keyway groove 52 prevents the key projection 54, and thus the actuator 20, from rotating about the longitudinal axis of the longitudinal bore 50 along the longitudinal axis of the body 12. Thus, the slidable interaction between the key projection 54 and the keyway groove 52 prevents the actuator 20 from rotating relative to the hinge 16, thereby maintaining the spray nozzle 36 in alignment substantially parallel with the axis of the hinge 16 as described above. The key projection 54 may alternatively be disposed on the interior peripheral surface of the longitudinal bore 50 and a complementary keyway groove 52 may be disposed in the outer peripheral surface of the actuator sidewall 34. Although only a single pair of keyway groove 52 and key projection 54 is shown in the drawings, additional complementary pairs of keyway grooves and key projections may be used if desired. Other types of complementary radial interference surfaces that allow translation of the actuator 20 along the longitudinal bore 50 and also prevent rotational movement of the actuator 20 within the longitudinal bore 50 may be used in addition or alternatively to the key/keyway configuration shown in drawings.

Preferably, the retention collar 42 fits onto the open top end of the body 12 in a radially fixed position. This may be accomplished with any suitable mechanism, such as a threaded connection between the retention collar 42 and the upper end of the body 12, or complementary opposing radial surfaces 56 and 58 on the outer periphery of the retention collar 42 and the inner peripheral wall of the body 12. The complementary opposing radial surfaces 56 and 58 may be formed by any number of different surfaces, such as a key and keyway or interaction between other features of the retention collar 42 and the body 12. However, in other embodiments, the retention collar 42 may be able to rotate about the longitudinal axis of the body 12.

The retention collar 42 preferably includes a coupler 60 that releasably couples to a top end of the canister 18 such that the dispensing tube 38 extends upwardly (longitudinally) into the longitudinal bore 50 to fluidly couple with a receiver bore in the actuator 20 and thereby also with the spray orifice in the spray nozzle 36. In this nonlimiting example, the coupler 60 is formed by a plurality of resilient fingers 62 extending downwardly from a bottom rim of the retention collar 42. Each of the resilient fingers 62 curves radially inwardly so as to snap fit onto a ring or collar defined near the top end of the canister 18. In the nonlimiting embodiment depicted in the drawings, the canister 18 includes a typical aerosol valve assembly including an aerosol valve 64 mounted in a top end of the canister 18 with a mounting cup 66 and the resilient fingers 62 resiliently snap fit onto and around and under a peripheral rim of the mounting cup 66 where the mounting cup 66 is swaged to the top end of a can portion of the canister 18. In this configuration, the dispensing tube 38 may be the valve stem of the aerosol valve assembly or may be fluidly coupled to the valve stem of the aerosol valve assembly. In this way, the retention collar 42 can be removed from the body 12 and releasably coupled to the top end of the canister 18, after which the canister 18 can be inserted into the cavity 20 through the open top end of the body 12 and the retention collar 42 reattached to the top end of the body 12. In this manner, the canister 18 may be loaded into the spray dispenser 10 and/or exchanged for a replacement canister 18.

To operate the fully assembled and operational spray dispenser 10 as shown in FIGS. 1-4, a user may simply grasp the elongate body 12 and open the lid 14, for example, by releasing the latch 24 and pivoting the lid 14 about the hinge 16 to expose the actuator 20. The user may then align the actuator 20 to point the dispensing spray nozzle 36 toward the intended target by placing the index finger into the recess 40 so that the recess 40 is aligned along the index finger. The user can then actuate the spray dispenser 10 by pushing the actuator 20 downwardly, thereby releasing the chemical irritant from within the canister 18 and directing a spray stream of the chemical irritant radially outwardly through the dispensing spray nozzle 36. If desired, the user may then reclose the lid 14 by pivoting the lid 14 back into the closed position with the bottom rim of the lid 14 disposed on the annular shoulder 48 and surrounding the annular neck 46, thereby again securely enclosing the actuator 20 inside the cavity 26 of the lid 14.

Optionally, a layer of decorative material 68 may be disposed on an outer peripheral surface of one or both of the body 12 in the tubular lid 14. In some nonlimiting embodiments, the decorative material 68 may be a soft material, such as a layer of leather, faux leather, silicon rubber or gel, or other similar soft material. In some nonlimiting embodiments, the decorative material 68 may include a sticker formed by a flexible sheet of sticker material secured to an exterior surface of the body 12 and/or lid 14 with an adhesive. The sticker material may be for example a paper or a plastic or combination thereof.

A lanyard hook 70 may optionally be disposed on an outer surface of the body 12 and/or the outer surface of the lid 14. The lanyard hook 70 may be used to secure a lanyard to the body 12 and/or the lid 14. In the nonlimiting example shown in FIG. 2, the lanyard hook 70 is formed by a U-shaped projection disposed at the bottom end of the body 12 and projecting radially outwardly. Other locations and/or shapes of the lanyard hook 70 are also contemplated.

Although the components of the spray dispenser 10 may be made of any suitable materials, such as plastic, metal, glass, composites, etc., a preferred aspect is that the body 12, lid 14, actuator 20, and retention collar 42 (and its components) may be made of an injection molded plastic and may include metallized accent features, for example metal foil coatings, in addition to the already mentioned decorative materials 68.

As previously noted above, although the foregoing detailed description describes certain aspects of one or more particular embodiments of the invention, alternatives could be adopted by one skilled in the art. For example, the spray dispenser 10 and/or any one or more of its components could differ in appearance and construction from the embodiments described herein and shown in the drawings, functions of certain components of the spray dispenser 10 could be performed by components of different construction but capable of a similar (though not necessarily equivalent) function, and various materials could be used in the fabrication of the spray dispenser 10 and/or its components. As such, and again as was previously noted, it should be understood that the invention is not necessarily limited to any particular embodiment described herein or illustrated in the drawings.

The invention claimed is:

1. A spray dispenser for spraying a stream of a chemical irritant comprising:

an elongate body having a longitudinal axis extending from a bottom end to a top end of the body, the body defining an interior cavity configured to receive a canister containing the chemical irritant;

a lid coupled to the top end of the body by a hinge so as to pivot between a closed position that covers the top end of the body and an open position that exposes the top end of the body;

an actuator at the top end of the body configured to selectively dispense the stream of chemical irritant from the canister disposed in the interior cavity when the lid is pivoted to the open position; and an anti-rotation actuator assembly that prevents the actuator from rotating about the longitudinal axis of the body, the anti-rotation actuator assembly comprising a retention collar on which the hinge is carried, a first radial surface on the retention collar engaging a second radial surface carried by the body to prevent the retention collar from rotating about the longitudinal axis of the body;

wherein the actuator extends into a lid cavity defined inside the lid when the lid is pivoted to the closed position.

2. The spray dispenser of claim 1, wherein the body has a tubular shape and the lid has a tubular shape that together define a single overall tubular shape that resembles a lipstick container.

3. The spray dispenser of claim 1, wherein the retention collar is releasably received in the top end of the body.

4. The spray dispenser of claim 1, wherein the anti-rotation actuator assembly comprises:

a longitudinal keyway disposed on one of an inner peripheral surface of the retention collar and an outer peripheral surface of the actuator; and a key disposed on the other of the inner peripheral surface of the retention collar and the outer peripheral service of the actuator;

wherein the key is slidably received in the longitudinal keyway such that the actuator can slide longitudinally relative to the retention collar and the key and the longitudinal keyway prevent the actuator from rotating about the longitudinal axis of the body.

5. The spray dispenser of claim 1, wherein the actuator comprises:

a peripheral sidewall extending downwardly from an outer peripheral edge of a top wall; and a spray outlet nozzle for emitting a spray of the chemical irritant radially outwardly from the sidewall;

wherein the spray outlet nozzle is aligned to emit the spray of the chemical irritant substantially parallel with a rotational axis of the hinge.

6. The spray dispenser of claim 1, wherein the retention collar further comprises a stepped annular shoulder surrounding an annular neck spaced radially inwardly from an outer peripheral surface of the retention collar, wherein the hinge is disposed radially outward from an longitudinally aligned with the annular neck and stepped annular shoulder, and wherein in the closed position a rim of the lid is disposed on the annular shoulder and has a slip fit onto the annular neck.

7. The spray dispenser of claim 1, wherein the actuator further comprises a recess in the top wall radially aligned with and spaced apart from the spray outlet nozzle and extending to a diametrically opposite portion of the peripheral sidewall.

8. The spray dispenser of claim 1, wherein the retention collar further comprises a coupler that releasably couples to the canister such that a dispensing tube from the canister fluidly connects to a spray orifice in the actuator.

9. The spray dispenser of claim 8, wherein the coupler comprises a plurality of resilient fingers that snap fit onto the canister and encircle the dispensing tube.

10. The spray dispenser of claim 1, further comprising the canister containing the chemical irritant and disposed in the interior cavity of the body.

11. The spray dispenser of claim 10, wherein the canister comprises an aerosol valve mounted in a top end of the canister with a mounting cup, and the dispensing tube comprises a valve stem of the aerosol valve, and the retention collar comprises a coupler that releasably couples to a rim of the mounting cup.

12. The spray dispenser of claim 1, wherein with the lid rotated about the hinge in the closed position, the spray dispenser has a length along the longitudinal axis of about 5 cm to about 15 cm, and wherein each of the body and the lid has a diameter of about 1 cm to about 7.5 cm.

13. The spray dispenser of claim 1, further comprising a lanyard hook disposed on an exterior surface of at least one of the body and the lid.

14. The spray dispenser of claim 1, wherein the chemical irritant comprises at least one of a pepper spray and mace.

15. A method of using the spray dispenser of claim 1, the method comprising:

pivoting the lid about the hinge from the closed position to the open position to expose the actuator;

pointing the actuator so as to spray a stream of the chemical irritant toward an intended target; and engaging the actuator to spray the stream toward the intended target.

16. The method of claim 15, further comprising pivoting the lid about the hinge from the open position to the closed position to cover the actuator.

17. The method of claim 15, further comprising preventing rotation of the actuator about the longitudinal axis relative to the hinge using the anti-rotation actuator assembly.

* * * * *